US007600461B1

(12) United States Patent
Cler et al.

(10) Patent No.: US 7,600,461 B1
(45) Date of Patent: Oct. 13, 2009

(54) MUZZLE BRAKE FOR CANNON

(75) Inventors: Daniel L. Cler, Coatesville, PA (US); David Forliti, Amherst, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/464,639

(22) Filed: Aug. 15, 2006

Related U.S. Application Data

(63) Continuation of application No. 11/460,694, filed on Jul. 28, 2006.

(60) Provisional application No. 60/595,912, filed on Aug. 16, 2005.

(51) Int. Cl.
*F41A 21/36* (2006.01)

(52) U.S. Cl. ..... 89/14.3

(58) Field of Classification Search ..... 89/14.3, 89/14.4

See application file for complete search history.

(56) References Cited

U.S. PATENT DOCUMENTS 1,363,058 A * 12/1920 Schneider ..... 89/14.3
1,555,026 A * 9/1925 Rose ..... 89/14.3
1,854,974 A * 4/1932 Bernat ..... 181/223
1,948,496 A * 2/1934 Barnes ..... 89/14.3
1,994,458 A * 3/1935 Barnes ..... 89/14.3
2,457,802 A * 1/1949 Bauer ..... 89/14.3
2,567,826 A * 9/1951 Prache ..... 89/14.3
2,778,278 A * 1/1957 Schwager et al. ..... 89/42.01
3,115,060 A * 12/1963 Ashbrook et al. ..... 89/14.3
3,152,510 A * 10/1964 Ashbrook et al. ..... 89/14.3
3,492,912 A * 2/1970 Ashbrook ..... 89/14.3
5,036,747 A * 8/1991 McClain, III ..... 89/14.3
5,119,716 A * 6/1992 Bartolles ..... 89/14.3
6,216,578 B1 * 4/2001 Ledys et al. ..... 89/14.3
2005/0252365 A1 * 11/2005 Balbo et al. ..... 89/14.3

FOREIGN PATENT DOCUMENTS

DE 19736363 A1 * 2/1999
WO WO 9854533 A1 * 12/1998

* cited by examiner

*Primary Examiner*—Troy Chambers

(57) ABSTRACT

A muzzle brake has a rear end, a front end and a central axis. The muzzle brake includes a plurality of axially spaced turning vanes; each turning vane having an inside diameter that is substantially equal to or greater than an inside diameter of a rearmost turning vane, at least one turning vane having an inside diameter that is greater than the inside diameter of the rearmost turning vane; and each turning vane having a thickness that is substantially equal to or greater than a thickness of the rearmost turning vane.

19 Claims, 7 Drawing Sheets

| POINT NUMBER | (X,Y) COORDINATES | 38 | −1.158,.120 |
|---|---|---|---|
| | | 39 | −1.091,.151 |
| 1 | .074,.004 | 40 | −1.024,.181 |
| 2 | .050,.001 | 41 | −.957,.212 |
| 3 | .019,.005 | 42 | −.890,.242 |
| 4 | .005,.019 | 43 | −.823,.273 |
| 5 | .000,.046 | 44 | −.756,.304 |
| 6 | .016,.088 | 45 | −.690,.337 |
| 7 | .030,.123 | 46 | −.624,.370 |
| 8 | .042,.158 | 47 | −.559,.405 |
| 9 | .053,.193 | 48 | −.495,.442 |
| 10 | .063,.229 | 49 | −.435,.485 |
| 11 | .072,.265 | 50 | −.396,.545 |
| 12 | .080,.301 | 51 | −.411,.587 |
| 13 | .086,.338 | 52 | −.448,.613 |
| 14 | .091,.375 | 53 | −.489,.634 |
| 15 | .094,.412 | 54 | −.551,.649 |
| 16 | .093,.497 | 55 | −.613,.665 |
| 17 | .088,.544 | 56 | −.675,.680 |
| 18 | .078,.591 | 57 | −.737,.695 |
| 19 | .064,.637 | 58 | −.799,.711 |
| 20 | .045,.681 | 59 | −.861,.726 |
| 21 | .022,.723 | 60 | −.923,.742 |
| 22 | −.004,.763 | 61 | −.985,.757 |
| 23 | −.034,.800 | 62 | −1.047,.773 |
| 24 | −.068,.834 | 63 | −1.109,.788 |
| 25 | −.104,.865 | 64 | −1.171,.804 |
| 26 | −.143,.893 | 65 | −1.233,.819 |
| 27 | −.168,.933 | 66 | −1.295,.835 |
| 28 | −.159,.975 | 67 | −1.357,.850 |
| 29 | −.132,.997 | 68 | −1.419,.865 |
| 30 | −.097,1.000 | 69 | −1.481,.881 |
| 31 | −1.654,−.017 | 70 | −1.543,.896 |
| 32 | −1.581,−.006 | 71 | −1.605,.912 |
| 33 | −1.508,.006 | 72 | −1.667,.927 |
| 34 | −1.436,.021 | 73 | −1.727,.942 |
| 35 | −1.365,.041 | 74 | −1.773,.952 |
| 36 | −1.295,.065 | 75 | −1.816,.962 |
| 37 | −1.226,.092 | 76 | −1.852,.969 |

FIG−5

MUZZLE BRAKE FOR CANNON

CROSS-REFERENCE TO RELATED APPLICATIONS

This application is a continuation-in-part of application Ser. No. 11/460,694 filed on Jul. 28, 2006. This application claims the benefit under 35 USC 119(e) of U.S. provisional patent application 60/595,912 filed on Aug. 16, 2005, which is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to muzzle brakes for gun tubes such as large caliber cannons, artillery, howitzers, tanks, and smaller caliber guns such as .50 caliber machine guns and guns carried by a one person.

High-efficiency muzzle brakes used on large caliber weapons have low numbers (two or three) of baffles with relatively large areas. The low number of baffles results in rapidly increasing muzzle brake forces, thereby producing high amplitude and high frequency loads due to the large area of the baffles and their few numbers. As an example, the M-284 Muzzle Brake used on the M-109 Paladin and the XM-777 Muzzle Brake used on the LW-155 Towed Howitzer both use a two baffle brake with large areas. Analysis of the M-284 muzzle brake shows very abrupt and high load levels from the first baffle of the muzzle brake.

Most baffled muzzle brakes do not take into account the supersonic flow environment in muzzle brakes. Those muzzle brakes use geometries that may work well in subsonic flow environments, or use geometries not based on good aerodynamic principals, such as flat places or poorly curved surfaces. As a result, the improperly designed geometries produce unsteady or oscillating flow fields in the supersonic flow environment.

Conventional low-profile muzzle brakes have lower efficiencies than is sometimes necessary for operational use of cannons, particularly for lighter-weight vehicles that require low system impulse. Conventional low-profile muzzle brakes typically use a pepper pot muzzle brake like the Crusader with a muzzle brake gas dynamic efficiency of approximately 0.6, or a combination pepper pot and Laval nozzle configuration like the Denel LEO muzzle brake with a gas dynamic efficiency of approximately 0.56. Low-profile muzzle brakes are desirable due to reduced weight and better system integration. If there is some hardware that needs to fit around the muzzle brake, a low-profile brake is desirable. To obtain higher efficiencies, muzzle brakes often become very large, as is the case for the M-284 Muzzle Brake or the XM-777 Muzzle Brake.

SUMMARY OF THE INVENTION

It is an object of the invention to provide a muzzle brake with a plurality of axially disposed vanes.

It is another object of the invention to provide a muzzle brake with a lower force loading per vane.

It is a further object of the invention to provide a muzzle brake having an increasing inside diameter in the direction of flow.

Still another object of the invention is to provide a muzzle brake having supersonic turning vanes.

Yet another object of the invention is to provide a muzzle brake having turning vanes that maintain a constant thickness in the direction of flow while the inside diameter increases.

One aspect of the invention is a muzzle brake having a rear end, a front end and a central axis, the muzzle brake comprising a plurality of axially spaced turning vanes; each turning vane having an inside diameter that is substantially equal to or greater than an inside diameter of a rearmost turning vane, at least one turning vane having an inside diameter that is greater than the inside diameter of the rearmost turning vane; and each turning vane having a thickness that is substantially equal to or greater than the thickness of the rearmost turning vane. In some embodiments, the inside diameters of the turning vanes increase from the rear to the front of the muzzle brake. Each turning vane extends at least partially circumferentially around the central axis.

In one embodiment, the muzzle brake further comprises a supersonic flow passage inside the muzzle brake wherein each turning vane is a supersonic turning vane comprising a suction side and a pressure side; the suction side including an expansion turning wall, the expansion turning wall comprising an angled portion and a substantially straight portion wherein the expansion turning wall creates an expansion fan that projects into the supersonic flow passage to turn supersonic flow into the turning vane; the pressure side comprising a large radius curved surface, the pressure side and the suction side converging to form a throat wherein a shock is formed upstream of the throat, the shock decelerating the supersonic flow to subsonic conditions and the pressure side turning the subsonic flow; the suction side including an outer nozzle expansion wall downstream of the throat, the outer nozzle expansion wall diverging from the pressure side to form an expansion nozzle that expands the subsonic flow to supersonic conditions.

In another embodiment, the muzzle brake further comprises a supersonic flow passage inside the muzzle brake wherein each turning vane is a supersonic turning vane comprising a suction side and a pressure side; wherein profiles of the suction side and the pressure side are defined using a rectangular coordinate system having an origin located adjacent an intersection of the pressure side and an edge of the supersonic flow passage, the profile of the pressure side defined by points 1 through 30 having substantially the coordinates of points 1 through 30 in FIG. 5 and the profile of the suction side defined by points 31-76 having substantially the coordinates of points 31-76 in FIG. 5, wherein a thickness of each turning vane has a value of one and the coordinates of points 1-76 are relative to the thickness of each turning vane.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 5 is a table of coordinates that define the profile of the turning vane of FIG. 2A.

DETAILED DESCRIPTION OF THE PREFERRED EMBODIMENTS

Figure 1:
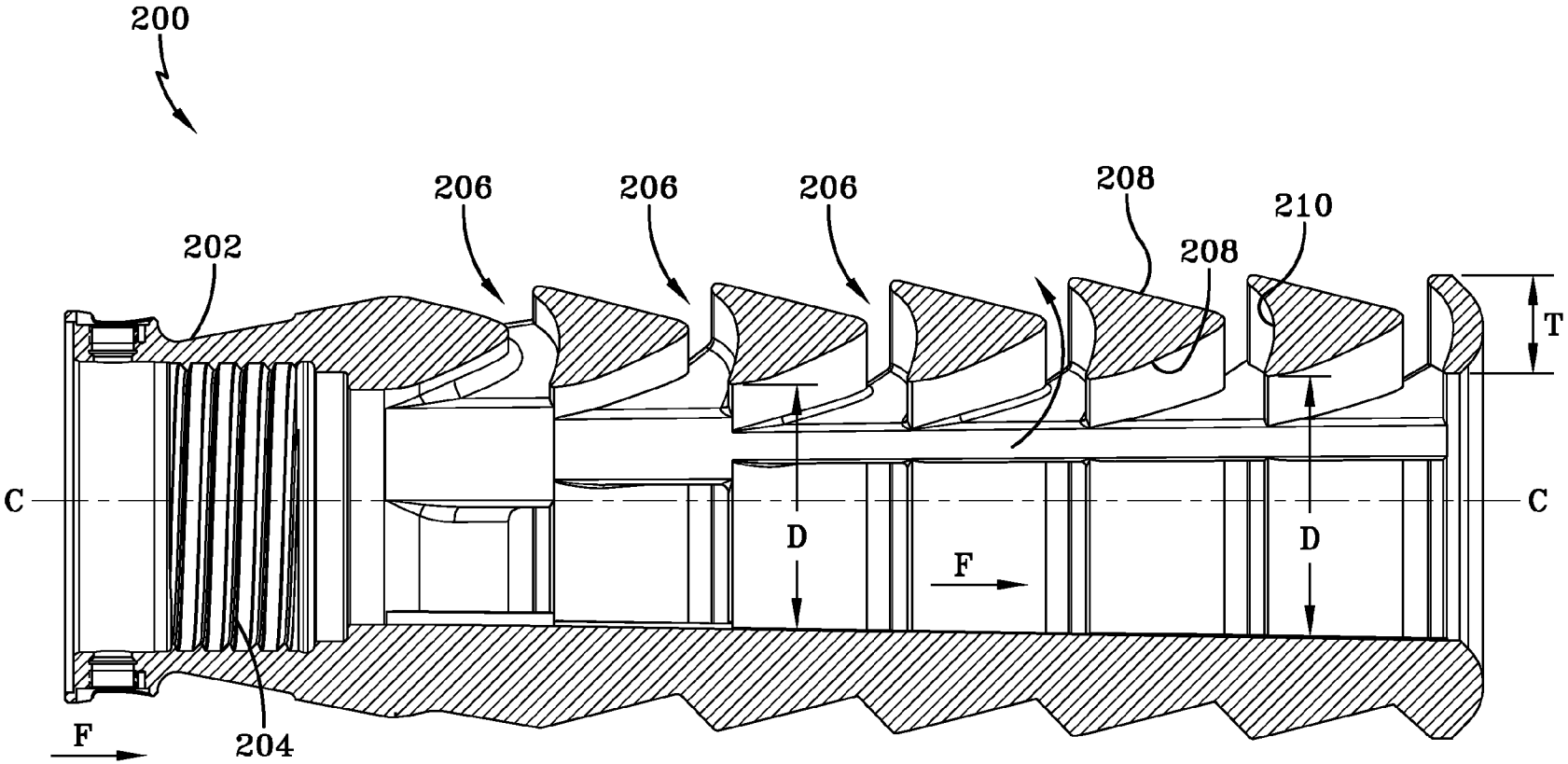
FIG. 1 is a sectional side view of one embodiment of a muzzle brake in accordance with the invention.

In the present invention, multiple turning vanes are used to spread muzzle brake loading out over time to reduce gun system high-frequency shock input. Compared to prior muzzle brakes, the invention uses smaller turning vanes, in larger numbers. As a result, the gun produces smaller increments of turning vane loading. Because pressure decreases from rear to front on a muzzle brake, it is desirable to use smaller vanes at the rear of the muzzle brake to produce more even loadings on the muzzle brake.

The invention encompasses a low-profile, high-efficiency muzzle brake. Higher efficiency reduces system weight and improves system integration. Given a maximum diameter for a muzzle brake, overall muzzle brake efficiency can be controlled by adding an appropriate number of vanes. The internal diameter of the vanes may be varied. A small internal diameter (less clearance around the projectile) is used at the rear of the brake and the internal diameter increases toward the front of the brake, while the overall increase in diameter is relatively small. Keeping the overall internal diameter small increases muzzle brake efficiency by forcing more propellant gas out of the muzzle brake.

By using a plurality of axially spaced turning vanes, the invention spreads the force loading out over a longer period of time. Further, by changing the vane thickness, the invention controls the average force per row on the muzzle brake. Typically, pressure is much higher for the first row of the muzzle brake. After the first row, the pressure drops rapidly. By controlling the turning vane width for a given vane thickness, the total loading per row can be controlled. By using a supersonic turning vane, a lower amplitude, high frequency noise response occurs due to a steadier flow environment. Thus, in one embodiment, the invention provides a low-shock, even-loading muzzle brake by combining a supersonic turning vane profile with a progression in vane widths from narrow at the rear of the brake to wider at the front of the brake, and a plurality of vanes to spread the loading out over the length of time the projectile travels down the barrel.

Because of its compact, low profile size, the muzzle brake is easier to integrate with retractable survivability shroud hardware on both future and prior art artillery systems. Moreover, the invention permits very narrow profiles, e.g., as thin as 1 inch or the thickness of a standard gun tube near the muzzle end of a gun. On the other hand, large thickness vanes may be used up to the limit of maximum diameter allowed by system or weight limitations. Because of the low-profile nature, longer muzzle brake lengths are achievable. The longer, low-profile, high-efficiency muzzle brake uses a sufficient number of supersonic turning vanes to achieve the required efficiency, based on the limitation of a maximum diameter. A brake with a plurality of supersonic turning vanes achieves efficiencies up to two to three times higher than other muzzle brakes of comparable size, and in some cases, higher efficiencies than large double-baffle muzzle brakes.

Figure 2:
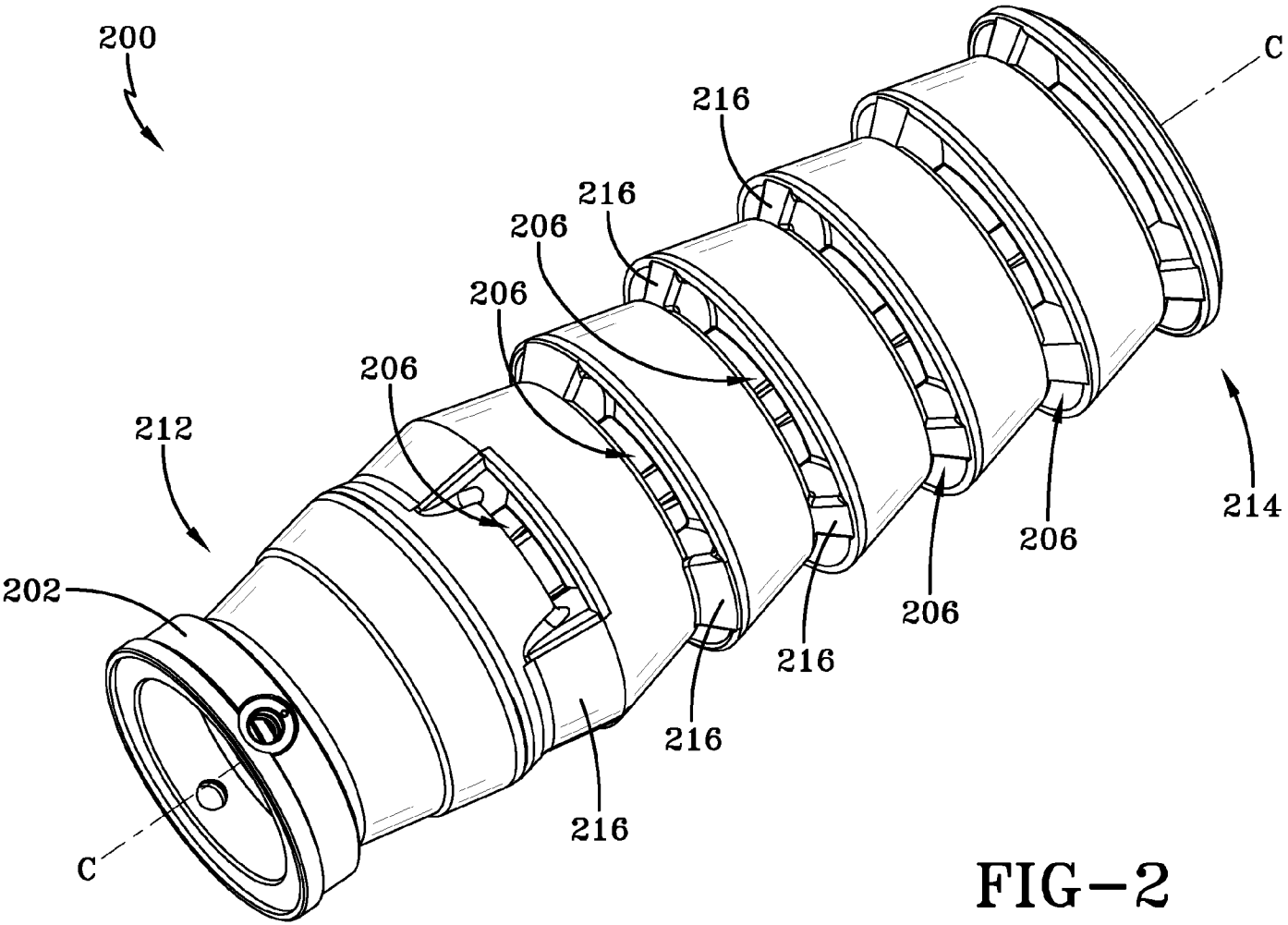
FIG. 2 is a perspective view of the muzzle brake of FIG. 1.

FIG. 1 is a sectional side view and FIG. 2 is a perspective view of one embodiment of a muzzle brake 200 in accordance with the invention. Muzzle brake 200 has a rear end 212, a front end 214 and a central axis C. At rear end 212 is a hub 202 for connecting the brake 200 to a gun tube. The hub 202 may have internal threads 204 for engaging external threads formed on the muzzle of a gun (not shown). The muzzle brake 200 includes a plurality of axially spaced turning vanes 206. In FIG. 1, six vanes 206 are shown. Fewer or more vanes 206 may be used, depending on the particular application and desired muzzle brake efficiency. More vanes result in a higher efficiency and less vanes result in a lower efficiency. The brake 200 includes at least one vane 206. Interior edges of the vanes 206 define a supersonic flow passage along the axis C in the interior of the brake 200.

The turning vanes 206 are defined by a suction side 208 and a pressure side 210. Each turning vane 206 has an inside diameter D. The rearmost vane 206 has the smallest inside diameter D. The remaining vanes have inside diameters at least as large as the inside diameter of the rearmost vane. To provide ample room for the projectile to pass through brake 200, it is preferred that the inside diameter of the vanes 206 increase in the direction of gas flow F. That is, from the rear 212 to the front 214, each turning vane 206 has a progressively larger inside diameter D.

Each turning vane has a thickness T. Preferably, each vane has the same thickness T. However, if constraints or limitations of the outside diameter make it desirous, the turning vane thickness could increase in the direction of flow. By controlling the total surface area of the vane, the total load on the vane may be controlled, based on the pressure applied to the vane in the muzzle brake.

As seen in FIG. 2, each turning vane 206 extends at least partially circumferentially around the central axis C. The circumferential extent of the vane 206 around the central axis C is the width of the vane and is expressed as a swept angle. The suction side 208 and the pressure side 210 of each turning vane 206 is connected by one or more supports 216. In addition to providing mechanical support for the vanes 206, the supports 216 lessen the widths of the turning vanes 206. That is, the supports 216 act as a barrier to the passage of fluid through the vanes 206.

The supports 216 may be used to vary the load on any vane. The greater the width of a support 216, the less area that is available for fluid flow and, consequently, the less load that is absorbed by the vane. Because the rearward vanes experience high pressures and loading, the supports 216 on the rearward vanes may be made with a greater width than the supports on the forward vanes. In addition, the larger widths of the supports 216 at the rear may be required to structurally support the higher loads from additional rows of turning vanes forward of the support location. Loads on the rear support are highest because these supports withstand the load of all the vanes.

The supports 216 of the rearmost vane 206 will have the greatest width, with each of the remaining turning vanes having supports with a width that is substantially equal to or less than the width of the support of the rearmost turning vane. In one embodiment, at least one turning vane 206 has a support with a width that is less than the width of the support of the rearmost turning vane. As seen in FIG. 2, the supports 216 at the rear of the brake 200 are the widest and the supports 216 at the front of the brake 200 are the narrowest.

In one embodiment of muzzle brake 200, supports 206 are circumferentially spaced about 120 degrees apart (measured from each support centerline). Thus, each axial vane location has three supports 206. The muzzle brake 200 is oriented such that one of the supports 206 is on the underside (facing the ground) of the muzzle brake 200. By using a combination of 120 degree spacing and a series of supports on the underside of the muzzle brake, gas flow is directed partially to the side and upwards. This reduces reflected blast waves and the resulting blast overpressure levels directly in front of the vehicle.

Figure 3:
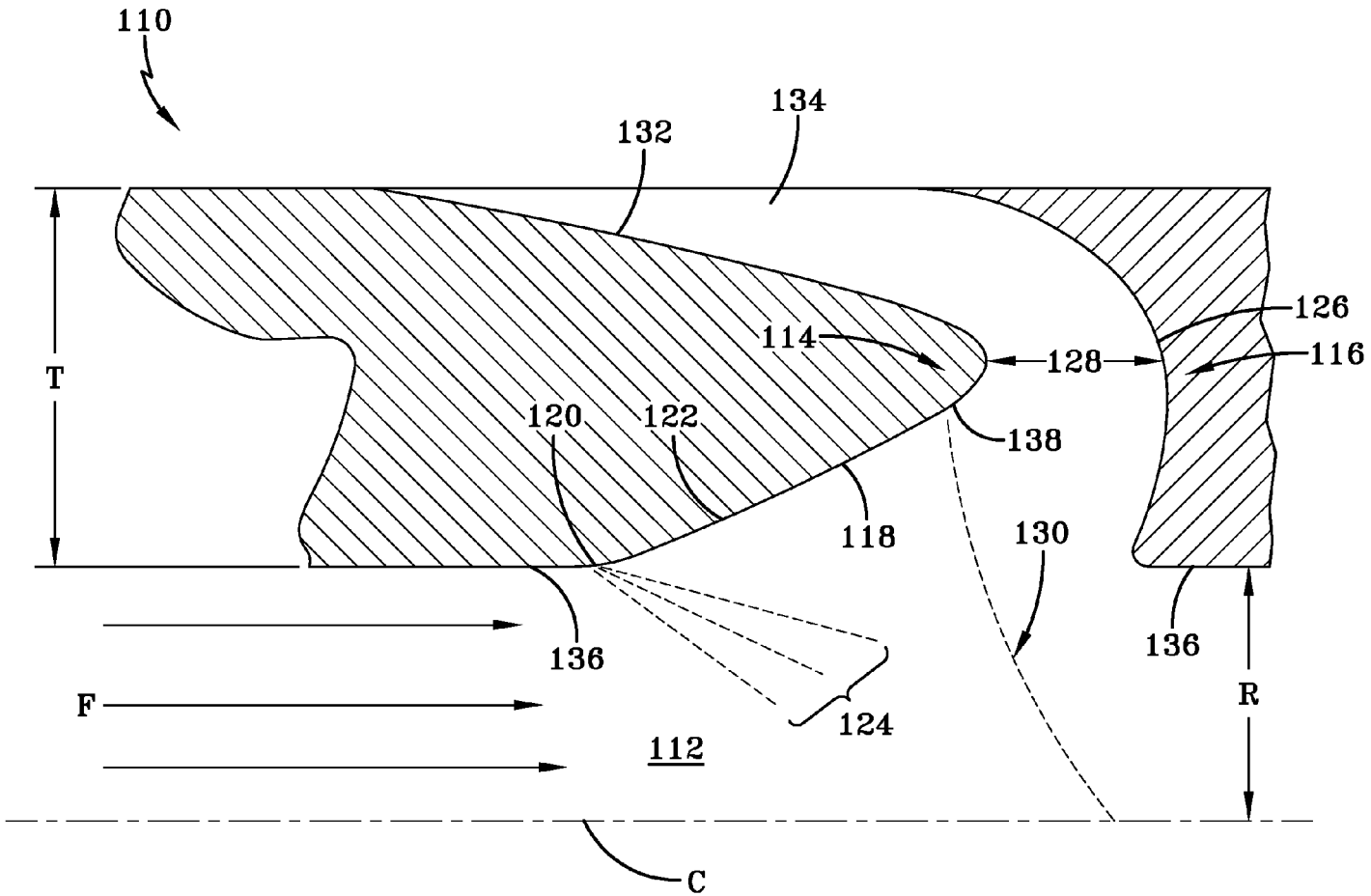
FIG. 3 is a side sectional view of one embodiment of a turning vane.

In one embodiment of muzzle brake 200, each turning vane 206 is a supersonic turning vane 110, as shown in FIG. 3. Supersonic turning vanes 110 produce lower amplitude high frequency noise. The supersonic turning vane 110 uses a series of compression and expansion waves to setup a steady flow pattern in the turning vane. As a result, high frequency noise is dramatically reduced. Supersonic turning vane 110 can efficiently turn supersonic flow over large turning angles in a very short distance. By scaling the supersonic turning vane to the appropriate size, a very narrow muzzle brake can be constructed.

Vanes 110 effectively decelerate supersonic fluid flow to subsonic speeds so that the flow may be efficiently turned. The downstream flow path includes an expanding passage that accelerates the high stagnation pressure flow to supersonic conditions, prior to exit. The shape of the turning vane 110 creates strategically located expansion fans and shocks. The expansion fans and shocks permit the effective deceleration of the flow for efficient subsonic turning. The turning vane 110 is optimized to utilize the expansion and compression waves that occur when supersonic flow is diverted from the centerline of the flow passage.

FIG. 3 is a sectional side view of one embodiment of a supersonic turning vane 110. In FIG. 3, only half of the turning vane 110 is shown. The other half of the turning vane 110 is a mirror image of FIG. 3 disposed on the opposite side of centerline C. To construct a three-dimensional turning vane 110, the section of FIG. 3 is rotated 360 degrees around the centerline C. Supersonic fluid flows in the direction shown by the arrow F in a flow passage 112 having a centerline C, a radius R and an edge or wall 136. The flow passage 112 is the interior of the muzzle brake 200. Radius R is one-half of the inside diameter of turning vane 110.

Turning vane 110 includes a suction side 114 and a pressure side 116. The suction side 114 includes an expansion turning wall 118 comprising an angled portion 120 and a substantially straight portion 122. The expansion turning wall 118 creates an expansion fan 124 (shown in dashed lines) that projects into the supersonic flow passage 112 to turn supersonic flow into the turning vane 110. The pressure side 116 comprises a large radius of curvature 126 relative to the chord length or passage hydraulic diameter.

The pressure side 116 and the suction side 114 converge to form a throat 128. The throat 128 is the area of minimum cross-section. A shock 130 (shown in dashed lines) is formed upstream of the throat 128. The shock 130 decelerates the supersonic flow to subsonic speed. The pressure side 116 turns the subsonic flow. The suction side 114 includes an outer nozzle expansion wall 132 downstream of the throat 128. The outer nozzle expansion wall 132 diverges from the pressure side 116 to form an expansion nozzle 134 that expands the subsonic flow to supersonic speed.

In the three-dimensional turning vane 110, support members 216 (FIG. 2) connect the suction side 114 to the pressure side 116 to support the vane. The support members are disposed circumferentially around centerline C. The turning vane 110 has a thickness T as shown in FIG. 3.

At angled portion 120, the wall 136 makes a relatively sharp turn and continues as a substantially straight section 122. The angled portion 120 and the substantially straight section 122 form the expansion turning wall 118 on the suction side 114 of the vane 110. The expansion turning wall 118 creates the expansion fan 124. Expansion fan 124 projects into the center core flow of the flow passage 112. The expansion fan 124 efficiently turns a portion of the supersonic flow F into the vane 110.

Slightly down the suction side 114, a shock 130 is formed due to separation in the area of point 138 along the suction side 114. The location of shock 130 is influenced by the angle of expansion wall 118, the change in radius at point 138, and the width of throat 128. The shock 130 decelerates the supersonic flow, which has been diverted by the expansion fan 124, to subsonic speeds. The subsonic flow is then turned by the pressure side 116 of the vane 110. The majority of the turning of the flow occurs at the pressure side 116. Because the flow is subsonic at the pressure side 116, the turning is very efficient. The throat 128 controls flow through the vane 110.

After the flow is turned, it is expanded in expansion nozzle 134 to supersonic speed. The pressure side 116 and the outer nozzle expansion wall 132 define nozzle 134. In nozzle 134, the pressure is reduced and additional thrust is produced. The design of vane 110 produces a relatively uniform mass flux throughout the vane. Thus, a small vane thickness T is able to achieve a high turning angle.

Figure 4A:
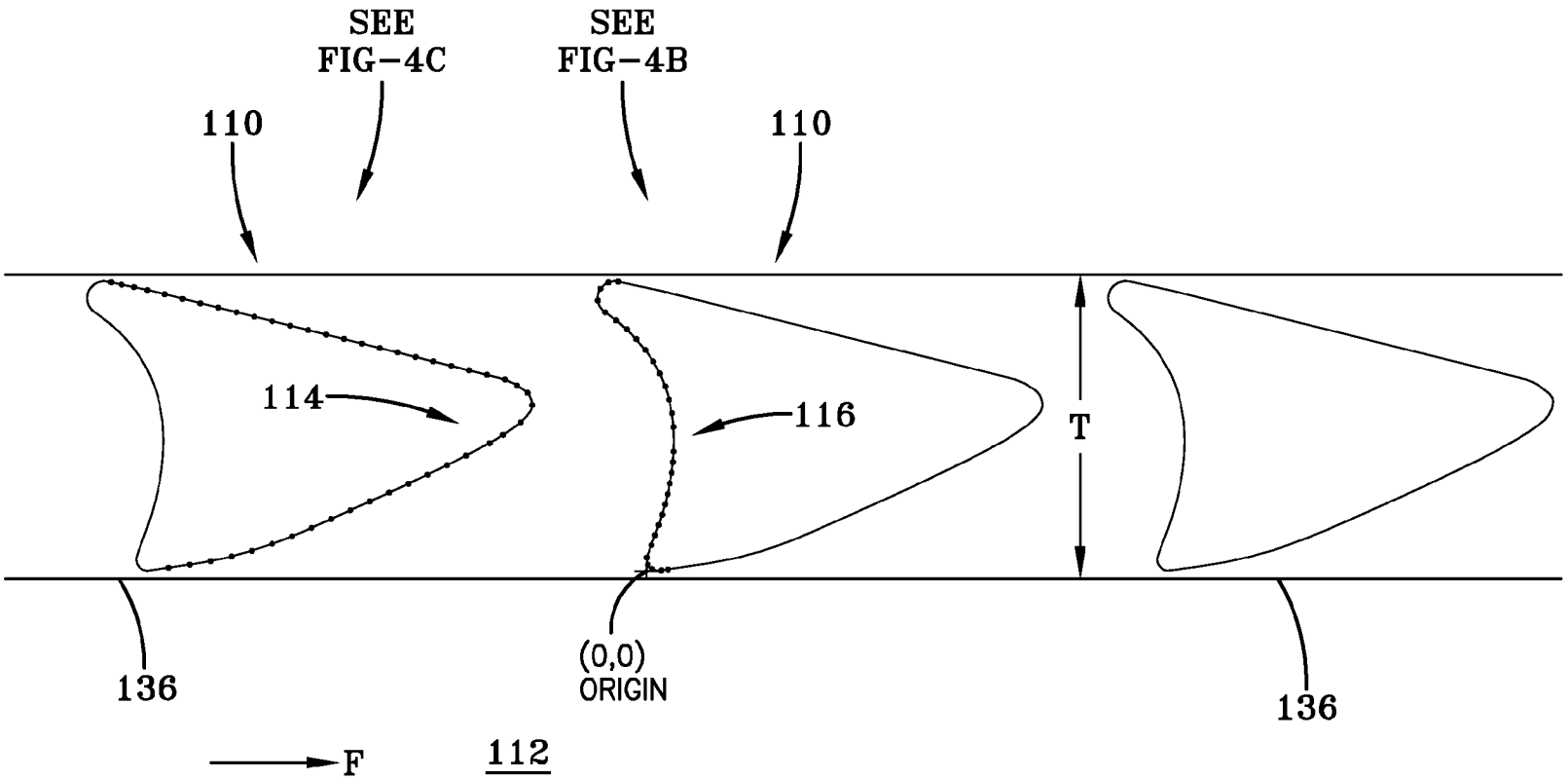
FIG. 4A is a schematic side view of the turning vane of FIG. 3, showing its dimensional relationships.

FIG. 4A is a schematic side view of the turning vane 110 of FIG. 1, showing its dimensional relationships. The method of describing the profile of vane 110 is similar to the method used for airfoils. A rectangular coordinate system has its origin 0,0 at a point near where the pressure side 116 intersects the flow passage 112. The profiles of the suction side 114 and the pressure side 116 are described by a plurality of points located on those sides and having X,Y coordinates relative to the origin 0,0. The X,Y coordinates of each point are dimensionless. The thickness T of the vane 110 is assigned a value of 1 and the coordinates of each point are relative to the thickness T. The value of the radius R of the flow passage 112 is not related to the profile of the turning vane 110.

Figure 4B:
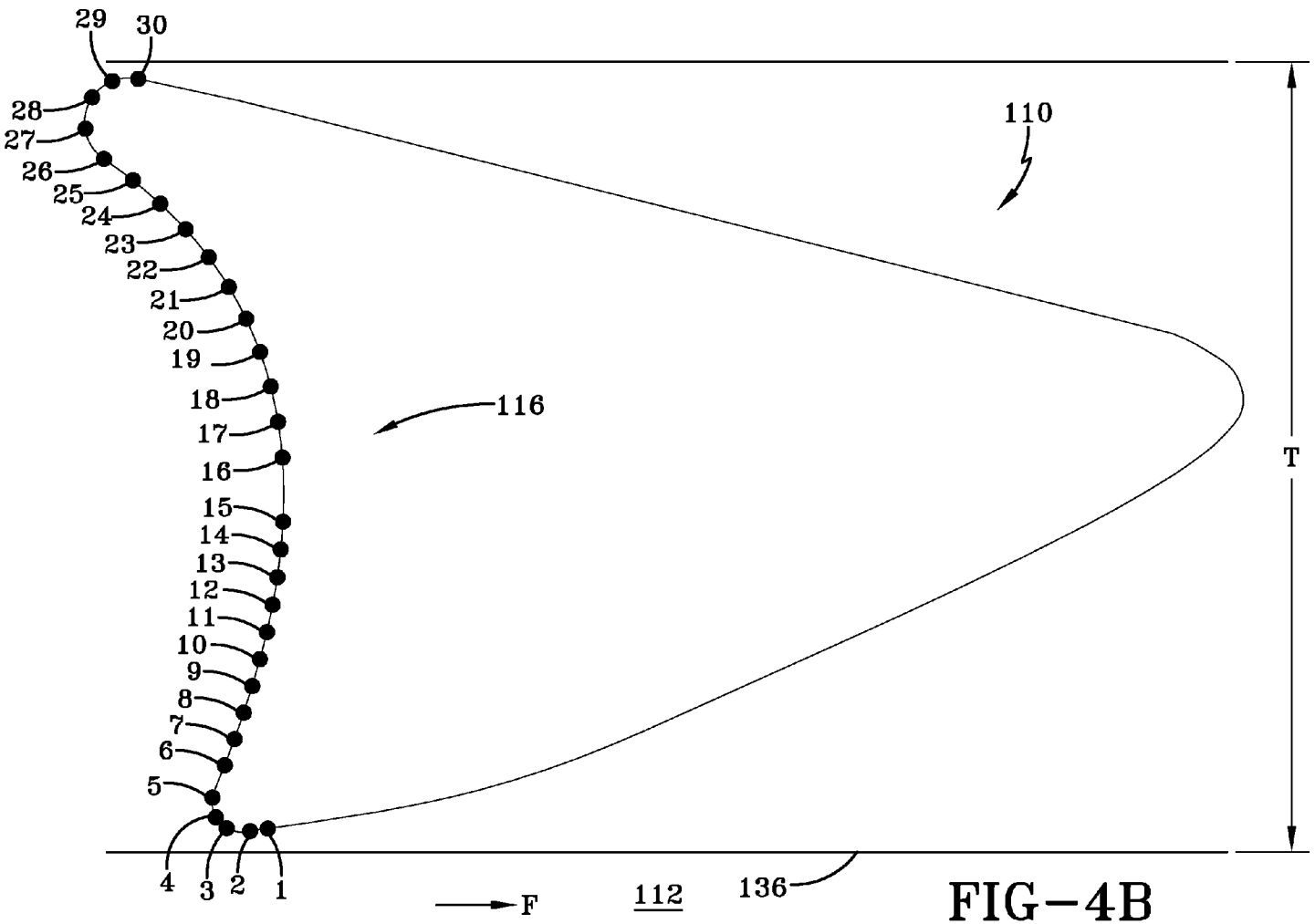
FIG. 4B is an enlarged view of the pressure side of the turning vane.
Figure 4C:
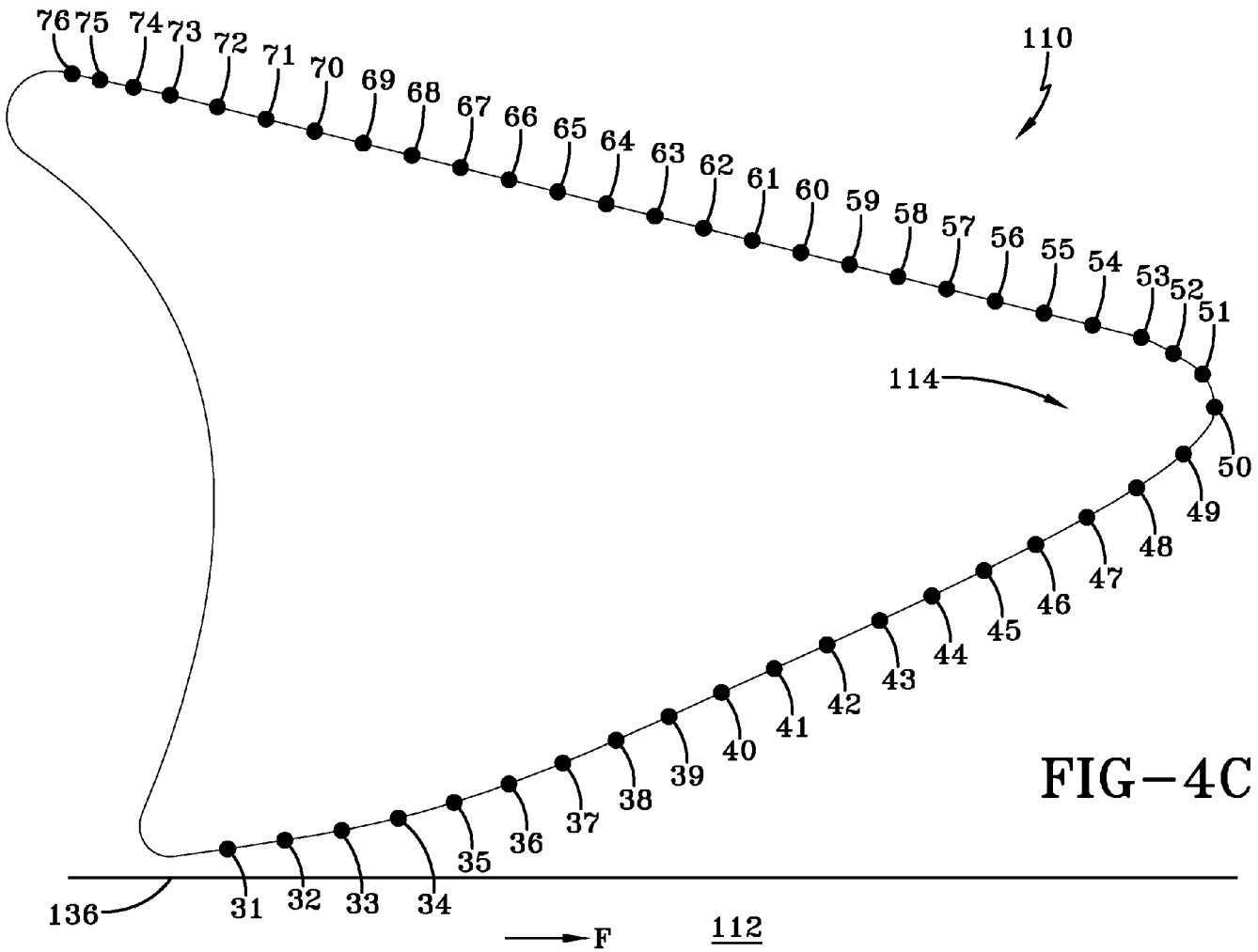
FIG. 4C is an enlarged view of the suction side of the turning vane.

In FIG. 4B, points 1-30 define the pressure side 116. In FIG. 4C, points 31-76 define the suction side 114. The X,Y coordinates for each point are given in FIG. 5. The inventive turning vane 110 has a shape such that the coordinates of its points correspond substantially to the coordinates in FIG. 5. Variations from the coordinates shown in FIG. 5 are allowable as long as the turning vane 110 functions as described above. FIGS. 4B and 4C are enlarged views of the pressure and suctions sides 116, 114, respectively.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A muzzle brake having a rear end, a front end and a central axis, the muzzle brake comprising:

a plurality of axially spaced turning vanes including a rearmost turning vane;

each of the plurality of axially spaced turning vanes having an inside diameter that is substantially equal to or greater than an inside diameter of the rearmost turning vane, at least one of the plurality of axially spaced turning vanes having an inside diameter that is greater than the inside diameter of the rearmost turning vane, none of the plurality of axially spaced turning vanes having an inside diameter that decreases in a direction from the rear end to the front end of the muzzle brake;

each of the plurality of axially spaced turning vanes having a thickness that is substantially equal to or greater than a thickness of the rearmost turning vane; and a supersonic flow passage inside the muzzle brake wherein each turning vane is a supersonic turning vane comprising a suction side and a pressure side; the suction side including an expansion turning wall, the expansion turning wall comprising an angled portion and a substantially straight portion wherein the expansion turning wall creates an expansion fan that projects into the supersonic flow passage to turn supersonic flow into the turning vane; the pressure side comprising a pressure side curved surface, the pressure side and the suction side converging to form a throat wherein a shock is formed upstream of the throat, the shock decelerating the supersonic flow to subsonic conditions and the pressure side turning the subsonic flow; the suction side including an outer nozzle expansion wall downstream of the throat, the outer nozzle expansion wall diverging from the pressure side to form an expansion nozzle that expands the subsonic flow to supersonic conditions.

2. The muzzle brake of claim 1 wherein the thickness of each turning vane is substantially equal to the thickness of the rearmost turning vane.

3. The muzzle brake of claim 1 wherein the inside diameters of the turning vanes increase from the rear to the front of the muzzle brake.

4. The muzzle brake of claim 2 wherein the inside diameters of the turning vanes increase from the rear to the front of the muzzle brake.

5. The muzzle brake of claim 3 wherein the thicknesses of the turning vanes increase from the rear to the front of the muzzle brake.

6. The muzzle brake of claim 1 wherein each turning vane extends at least partially circumferentially around the central axis.

7. The muzzle brake of claim 6 wherein each turning vane comprises a suction side and a pressure side connected by supports.

8. The muzzle brake of claim 7 wherein each turning vane has three supports circumferentially spaced about 120 degrees apart and oriented so that one support is located on an underside of the muzzle brake.

9. The muzzle brake of claim 8 wherein the supports of each turning vane have a width that is substantially equal to or less than a width of a support of the rearmost turning vane and at least one turning vane has a support with a width that is less than the width of the support of the rearmost turning vane.

10. The muzzle brake of claim 1 wherein profiles of the suction side and the pressure side are defined using a rectangular coordinate system having an origin located adjacent an intersection of the pressure side and an edge of the supersonic flow passage, the profile of the pressure side defined by points 1 through 30 having substantially the coordinates of points 1 through 30 in FIG. 5 and the profile of the suction side defined by points 31-76 having substantially the coordinates of points 31-76 in FIG. 5, wherein a thickness of each turning vane has a value of one and the coordinates of points 1-76 are relative to the thickness of each turning vane.

11. The muzzle brake of claim 10 wherein the thickness of each turning vane is substantially equal to the thickness of the rearmost turning vane.

12. The muzzle brake of claim 11 wherein the inside diameters of the turning vanes increase from the rear to the front of the muzzle brake.

13. The muzzle brake of claim 10 wherein the inside diameters of the turning vanes increase from the rear to the front of the muzzle brake.

14. The muzzle brake of claim 10 wherein the thicknesses of the turning vanes increase from the rear to the front of the muzzle brake.

15. The muzzle brake of claim 10 wherein each turning vane extends at least partially circumferentially around the central axis.

16. The muzzle brake of claim 15 wherein each turning vane comprises a suction side and a pressure side connected by supports.

17. The muzzle brake of claim 16 wherein each turning vane has three supports circumferentially spaced about 120 degrees apart and oriented so that one support is located on an underside of the muzzle brake.

18. The muzzle brake of claim 17 wherein the supports of each turning vane have a width that is substantially equal to or less than a width of a support of the rearmost turning vane and at least one turning vane has a support with a width that is less than the width of the support of the rearmost turning vane.

19. The muzzle brake of claim 18 wherein widths of the supports decrease from the rear to the front of the muzzle brake.

* * * * *